US008815053B2

(12) United States Patent
Vehmaa et al.

(10) Patent No.: US 8,815,053 B2
(45) **Date of Patent: *Aug. 26, 2014**

(54) METHOD OF TREATING LIQUID FLOWS AT A CHEMICAL PULP MILL

(75) Inventors: Janne Vehmaa, Siltakyla (FI); Olavi Pikka, Kotka (FI); Pekka Tervola, Espoo (FI)

(73) Assignee: Adritz Oy, Helsinki (FI)

( * ) Notice: Subject to any disclaimer, the term of this patent is extended or adjusted under 35 U.S.C. 154(b) by 0 days.

This patent is subject to a terminal disclaimer.

(21) Appl. No.: 13/512,220

(22) PCT Filed: Nov. 22, 2010

(86) PCT No.: PCT/FI2010/050943

§ 371 (c)(1),
(2), (4) Date: Jul. 25, 2012

(87) PCT Pub. No.: WO2011/064447

PCT Pub. Date: Jun. 3, 2011

(65) Prior Publication Data

US 2012/0279669 A1 Nov. 8, 2012

(30) Foreign Application Priority Data

Nov. 25, 2009 (FI) ..... 20096243

(51) Int. Cl.
*D21C 11/00* (2006.01)

(52) U.S. Cl.
USPC ..... 162/29; 162/60; 162/65; 162/70; 162/75

(58) Field of Classification Search
USPC ..... 162/29, 60, 65, 70, 75, 242
See application file for complete search history.

(56) References Cited

U.S. PATENT DOCUMENTS

| | | | | |
|---|---|---|---|---|
| 4,070,234 | A | 1/1978 | Anderson et al. | |
| 5,127,992 | A * | 7/1992 | Davies et al. | 162/29 |
| 5,380,402 | A * | 1/1995 | Ryham et al. | 162/30.1 |
| 5,849,197 | A * | 12/1998 | Taylor et al. | 210/652 |
| 6,733,625 | B2 * | 5/2004 | Henricson et al. | 162/60 |

(Continued)

FOREIGN PATENT DOCUMENTS

| | | | |
|---|---|---|---|
| WO | 98/29598 | A1 | 7/1998 |
| WO | 2008/152185 | A2 | 12/2008 |

OTHER PUBLICATIONS

International Search Report mailed Mar. 8, 2011.

*Primary Examiner* — Mark Halpern
(74) *Attorney, Agent, or Firm* — Nixon & Vanderhye P.C.

(57) ABSTRACT

A method of treating and utilizing liquid flows at a chemical pulp mill including stages for: a) chemical pulp is produced in an alkaline cooking process, b) the brown stock generated in the cooking is treated, said treatment comprising washing of the stock and preferably oxygen delignification and subsequent washing of the stock, c) a bleaching process for the brown stock, the bleaching sequence comprising at least one stage using chlorine dioxide and additionally at least one oxidizing bleaching stage and having at least two washing stages for treating the stock with liquids and for producing filtrates, and d) filtrates from stage c) are purified at an effluent treatment plant of the chemical pulp mill, which comprises at least biological treatment, for obtaining purified effluent. The method further includes a stage e), where the purified effluent with a color of 200 mg/l (Pt color) or more and a COD value of over 150 mg/l is used as pulp treatment liquid in stage c).

8 Claims, 2 Drawing Sheets

(56) References Cited

U.S. PATENT DOCUMENTS

2002/0088567 A1* 7/2002 Henricson et al. ..... 162/29
2010/0224334 A1* 9/2010 Vehmaa et al. ..... 162/29
2010/0243183 A1* 9/2010 Vehmaa et al. ..... 162/29
2010/0243184 A1* 9/2010 Vehmaa et al. ..... 162/29

* cited by examiner

METHOD OF TREATING LIQUID FLOWS AT A CHEMICAL PULP MILL

RELATED APPLICATION

This application is the U.S. national phase of International Application No. PCT/FI2010/050943 filed 22 Nov. 2010 which designated the U.S. and claims priority to 20096243 filed 25 Nov. 2009, the entire contents of each of which are hereby incorporated by reference.

BACKGROUND

The present invention relates to a method of treating and utilizing liquid flows at a chemical pulp mill, where wash filtrates are purified at an effluent plant of the chemical pulp mill comprising at least biological purification.

The size of chemical pulp mills has grown intensively during the last years, as today a pulp mill producing 1 million ton/a is of normal size and it does not seem that the growth of the size of pulp mills would be ceasing. At the same time that the size of the pulp mills is growing, the mills are being built in areas and surroundings with very strict environmental regulations. For example, the amount of water used by a mill is being continuously restricted. Because the size of the mill grows, minor decreases in the water amounts used by the mill per one ton of pulp do not absolutely decrease the amount of water used by the mill, but the amount is compensated back to the same level as the production size increases. This development is troublesome especially in countries where the amount of water available for the mill simply is not enough. In this kind of situation it is simply impossible to build a mill at a place where other demands of production are easily fulfilled, but due to water resources it is not possible to build a mill. Additionally, in many areas a cleaner environment is desired in such a way that the mills produce substances that are less detrimental to the environment. Therefore, it is essential to look for solutions for finding an increasingly closed process.

Chlorine-containing chemicals have been used throughout the production of chemical pulp in several different forms, of which elemental chlorine $Cl_2$, chlorine dioxide $ClO_2$ and hypochlorite NaOCl or CaOCl are the best known. Chlorine-containing chemicals have been used also e.g. in the form of hypochlorous acid in bleaching, but no permanent applications have remained in use. On the other hand, the chemical pulp industry has desired to tightly maintain a technique in which pulp is bleached with chlorine-containing chemicals so that chlorine dioxide is the main chemical of the bleaching process of the mill. Years-long pressure to reduce the amount of organic chlorine compounds in bleaching effluents has led to the point that first the use of chlorine and hypochlorite was abandoned and further the kappa number of the pulp after digestion was decreased from level 30 to level 10-15 for soft wood and from level 16-20 to level 10-13 for hard wood using an oxygen stage. In 1990s, the aim was to abandon the use of chlorine dioxide as well and many mills switched to the use of total chlorine free (TCF) bleaching technique, wherein the use of chlorine dioxide, too, was replaced by totally chlorine-free bleaching chemicals, such as ozone and peroxide. With this technique, all chlorine-containing chemicals could be avoided, but on the other hand, many paper producers were not satisfied with the properties of pulp produced without chlorine chemicals. Therefore, the marginal term for all solutions relating to the closing of the mill is that chlorine dioxide is still used as bleaching chemical.

Thus the dominating position of chlorine dioxide as bleaching chemical has even gained more power during the last years, and not even the latest researches or industrial experiences have managed to destabilize its position, but as a rule the whole pulp industry, with only a few exceptions, has approved the use of chlorine dioxide as the key chemical in bleaching. Thus, if a mill is to further decrease the amount of organic chlorine compounds, the aim of the mills will be, first and foremost, to eliminate them and to treat them inside the mill, rather than to decrease the use of chlorine dioxide.

Modern ECF-bleaching used for bleaching pulp, is typically formed of at least three bleaching stages and three washing apparatuses. In a special case there may be only two washing apparatuses, but such applications are rare. ECF-bleaching covers all such bleaching sequences, which have at least one chlorine dioxide stage and which do not use elemental chlorine in any bleaching stage. Because the use of hypochlorite is due to pulp quality reasons restricted to the production of only a few special pulps, such as dissolving pulps, also hypochlorite is not regarded to be used in the production of ECF-pulp, but it is not totally ruled out. Additionally, the bleaching sequence comprises one alkaline stage, wherein the additional chemicals used are today typically either oxygen, peroxide or both. Further, modern bleachings may use ozone, various types of acid stages and a chelate stage for removing heavy metals. In literature, the bleaching stages are described with letters:

O=oxygen delignification
D=chlorine dioxide stage
H=hypochlorite stage
C=chlorination stage
E=alkaline extraction stage
E0=alkaline extraction stage using oxygen as additional chemical
EP=alkaline extraction stage using peroxide as additional chemical
EOP(PO)=alkaline extraction stage using oxygen and peroxide as additional chemical
P=alkaline peroxide stage
A=acid hydrolysis stage, stage of removal of hexenuronic acids
a=pulp acidation stage
Z=ozone stage
PAA=peracetic acid stage, acid peroxide stage In this patent application the chemical amounts and other amounts are given per one ton of air dry pulp (adt pulp, i.e. air dry metric ton of 90% dry chemical pulp).

When bleaching is called ECF-bleaching, the amount of chlorine dioxide used in the bleaching sequence is more than 5 kg act.Cl/adt pulp. If chlorine dioxide is used in one bleaching stage, most typically the doses are between 5-15 kg act. Cl/adt. The doses refer to active chlorine, whereby when converting to chlorine dioxide the dose has to be divided by a ratio of 2.63.

If the use of peroxide in bleaching is restricted to doses smaller than 6 kg and if chlorine dioxide is the main bleaching chemical, so then the chlorine dioxide dose in the bleaching increases from a level of 25 kg/adt depending on the bleaching properties of the pulp and on how much the kappa number of the pulp has been decreased before starting the bleaching using chlorine-containing chemicals. Thus, the bleaching technique may in view of the process be fairly freely adjusted to various levels of chlorine dioxide consumption so that the amount of chlorine-containing chemicals exiting the bleaching corresponds to the capacity of the chemical cycle to receive chlorides.

In connection with the present invention it is in view of practice most preferable to choose as reference sequence for hard wood a bleaching sequence ND-EOP-D-P effected with four bleaching stages and leave ozone out. The corresponding sequence for soft wood is D-EOP-D-P. Then the quality of the pulp can be regarded to correspond to the qualities required from ECF-pulp and the pulp yield remains reasonable. Then the chlorine dioxide doses for soft wood are typically between 25-35 kg/adt pulp and for hard wood 20-30 kg/adt. These values can be regarded as design values, and there is no need to invent any new specific techniques for bleaching. The theory of bleaching and various connection alternatives render a possibility for countless different bleaching sequences starting from the connection of two washing apparatuses up to six-stage bleaching sequences. At the same time, the number of chlorine dioxide stages may vary from one up to four and therebetween are alkaline stages as appropriate.

When the amount of active chlorine is calculated as described above in form of the chloride amount, it is noted that even with soft wood, for obtaining a good bleaching result, the bleaching line produces about 10 kg of chlorides per one ton of pulp and a hard wood bleaching line even less. If the plant is closed such that less and less of fresh water is led into bleaching, there may be a need to prepare for chlorine dioxide doses of even 50% greater, and on the other hand the amount of chlorides in bleaching effluents increases up to a level of approximately 15 kg, meaning that in practice the greatest doses of active chlorine are 60-70 kg/adt. Values higher than this cannot be considered economically reasonable, but the basic bleaching solution complies with these starting points. On the other hand, the aim of the present invention is to introduce an alternative, with which the closing of bleaching does not essentially increase chemical consumption.

One suggested technique for decreasing the environmental effects of chlorine-containing chemicals is the closing of the liquid cycles of bleaching plants, and modern bleaching plants have reached to a level of 10-15 $m^3$ of effluent/adt pulp without a decrease in pulp quality. Nevertheless, even when decreasing the amount of bleaching effluent from a level of 15 $m^3$/adt pulp to a level of 10 $m^3$/adt an increase in chemical consumption is seen, which thus leads to an ever increasing amount of organic chlorine compounds from bleaching. Thus, a conclusion may be drawn that the closing of the water cycles of bleaching as such does not have a direct influence in the amount of organic chlorine compounds; but on the other hand a smaller amount and a greater concentration of effluents allow for easier and more economical purification thereof.

Chloride-containing chemicals are used in bleaching so that the total chloride dose into the bleaching plant is 5-10 kg of chlorides per one ton of chemical pulp. Because this amount has to be made to pass so that the amount of liquid to be evaporated in the process remains reasonable, the challenge is to find such a process arrangement, where a chloride-containing liquid replaces some other liquid used in a process at the mill. Thus there is no need for separate treatment stages, new non-productive sub-processes at the mill, but the treatment can be carried out by means of existing process stages.

In order to be able to optimize the treatment of a chloride-containing liquid and in practice the treatment of bleaching effluent, it is inevitable to first know the properties of the effluent. In the bleaching, chlorine-containing inorganic compounds and organic chlorine compounds from the reactions of chlorine dioxide or chlorine remain in the process. Bleaching separates from the fibers various compounds of lignin, which remain in the effluent in form of organic molecules. Additionally, sulfuric acid is used in bleaching for pH regulation and as main chemical in the hydrolysis of hexenuronic acids. Sodium hydroxide is also used for pH regulation and lignin extraction in alkaline stages. In addition to these, depending on the bleaching sequence, oxygen and peroxide are used in bleaching, which, however, are in elementary analysis such substances that their contribution in for example purification processes is not noticed. In some special cases, also hydrochloric acid may be used in pH regulation and sulfur dioxide or other reductants in elimination of chemical residuals from the bleaching, i.e. in elimination of unreacted bleaching chemicals.

Closing of the bleaching is based on recirculation of filtrates of washing apparatuses from later bleaching stages to preceding stages. The bleaching is planned only for circulating filtrates between bleaching stages and pulp from one stage to another to react with different bleaching chemicals. Thus, closing the whole bleaching is as an idea based on the fact that all substances separated in bleaching end up in filtrates. Optimizing the closing of bleaching is in a great part based on the way how reaction products of bleaching disturb the process of bleaching. Although in many various connections it has been stated that different degrees of closing are possible, practical experience has shown that such washing water arrangements of bleaching where the filtrates are connected so that the amount of waste water is less than 12-13 $m^3$/adt increase the consumption of bleaching chemicals. Naturally, the quality of the pulp and the construction of the bleaching plant dictate the amount of additional chemicals used in the bleaching as the effluent amount of the plant decreases below the above presented level.

U.S. Pat. No. 5,470,480 presents a method with which e.g. an effluent flow of a chemical pulp mill is treated so that hydrogen peroxide is added thereto and the flow is exposed to ultraviolet radiation for forming of hydroxyl radicals from the peroxide. Hydroxyl radical oxidize organic impurities in the effluent flow in order to reach a desired purity level e.g. in form of chemical oxygen demand, COD, or expressed in form of color. The treated effluent flow can be recirculated back to the chemical pulp mill e.g. to pulp washing in bleaching. The color of the effluent is reduced in the method remarkably, as measured by Color Method EPA 111.2, to below 500, most preferably to below 20. According to an embodiment, unpurified acid effluent is added to the water thus purified, the mixture is treated in an oxidation pond, after which a portion of it can be circulated to bleaching.

EP863113 discloses a method, in which the alkaline filtrate of bleaching at a chemical pulp mill is treated (i.a. by means of ultrafiltration) so that an alkaline concentrate is formed that contains abundantly of organic compounds having a high molecular weight, and a flow from where the organic compounds have been removed. Said fractions can be used in brown stock washing. Said fractions can be used in brown stock washing. Recovery of these fractions allows decreasing the amount of AOX being removed from the bleaching plant to an effluent treating plant or to a surrounding water system. The acid effluent is treated in biological effluent treatment, in order to obtain the desired AOX, COD and color values for the effluent of the mill to the environment.

Publication Fontanier, V., et al. ("Simulation of Pulp Mill Wastewater Recycling after Tertiary Treatment", Environ. Technology, 2005, Vol. 26, s. 1335-1344) has studied the circulation at a chemical pulp mill of effluent treated in a biological treatment plant and effluent that has not been treated. It was stated in the study that said effluent is to be further treated in a tertiary stage for preventing the increase in bleaching chemical consumption and the decrease in pulp brightness. The most efficient tertiary treatment was catalytic ozonization. Effluents were recirculated to E0-stage, to purification and pressing after D2-stage. The tertiarily treated effluent produced almost the same COD-contents as the use of clean water. The use of untreated effluent from the biological purification, plant, in its turn, led to high COD-amounts, which can cause excess consumption of bleaching, chemicals (e.g. NaOH in the E0-stage) and loss of pulp brightness. Untreated biological effluent has high COD- and color levels, whereas the corresponding values of effluent treated by catalytic ozonization are low. The use of untreated effluent is said to possibly cause damage at several points of the process due to the high COD-levels. That is, also according to this publication, liquids used in pulp treatment should be liquids with a purity level close to that of clean water.

The brown color of effluents is mainly of organic origin, especially from lignin decomposition products that are formed in different stages of pulp cooking and bleaching. Other substances that produce color are wood extractives as well and tannins and resins. Decolorization of effluents prior to leading them to a surrounding water system is considered important, because it is considered to have a detrimental influence on the living organisms and plants of the water system. According to said publications, the effluents are to be decolorized also before re-use in a pulping process for obtaining pulp of good quality.

WO-patent publication 2008152185 (FI-application 20080144) discloses a method with which purified effluent in an amount of at least 1 $m^3$/adt pulp is introduced into dilution after a press or washing press, which effluent is passed from the dilution into the first process stage of bleaching. Preferably the effluent has been biologically purified for decreasing the lignin-content.

WO-patent publication 2008152186 (FI-application 20080298) describes a method with which more than one treatment line is arranged at the effluent purification plant for the mill effluents and effluents with different chemical compositions are purified in separate treatment lines so that the quality and amount of purified water from each treatment line is suitable for use in a stage or stages of the production process, whereto purified effluent is returned. With this method one or more filtrates of a bleaching sequence can be taken into a purification treatment and returned typically as washing or dilution water to bleaching and/or brown stock washing. The object of use of purified effluent is an object where this purified effluent is most suitable in view of its composition, such as chemical composition. Also in this method the effluent has been biologically purified for decreasing the lignin-content. The lignin-content of effluent decreased without dilution by at least 30%, preferably over 40%, most preferably over 60%.

The standard defined by the Technical Association of Pulp and Paper Industry Tappi, where e.g. the limit for color is very low, is still considered the quality requirement for raw water used at a bleaching plant. The quality of water has been considered a critical factor and therefore there has been no desire to depart from the standard, except for those exceptional cases when reaching the quality requirements is impossible due to the poor quality of the mill's raw water. In these cases, too, the attempt has been to get the quality of the water to be as close to the requirements set by standard as possible.

The most important component that causes brightness loss is lignin. In secondary treatment of effluent the color does not change, even though the lignin-content decreases. This has led to erroneous interpretation of the significance of color in the waters and filtrates of a pulp bleaching process.

SUMMARY OF THE INVENTION

A method has been conceived for further improving the preconditions for closing water circulations of a chemical pulp mill and thus for decreasing the amount of clean water that is required, especially at the bleaching plant of a chemical pulp mill. The brightness and quality of the pulp are to remain at the same level as in known methods.

Partial closing of bleaching and external purification of the generating filtrates (with a volume of 10-15 $m^3$/adt) using e.g. filtration, various known forms of biological treatment, different techniques of chemical treatment, and clarification have been regarded as the so-called best available technology for bleaching effluents. After this, the treated water is led back to the water system to the same channel wherefrom the liquid was taken to the mill process or to a different channel. This is in use at both TCF- and ECF-pulp mills. Biological treatment is efficient specifically when the proportion of detrimental organic substances is decreased, which mainly comprise lignin compounds separated in bleaching, hemicelluloses and components originating from extractives, which constitute a significant portion of effluent coming from the bleaching plant. There is an ample amount of various wood-originating compounds, and some of the compounds are chlorinated and some of them are low-molecular compounds of carbon and hydrogen. Because microbes behave so that their nutrition mainly comprises the organic part of the effluent, all inorganic substances, at least inorganic elements remain in the effluent in one form or other independent on whether or not the microbes have needed them as nutrition. Thus, biologically treated water has an organic load that makes it clearly cleaner than effluent treated in other ways, but due to the inorganic substances, above all chlorine, the only choice has been to discharge it from the process. Additionally, after secondary purification the color of the effluent remains very much unchanged compared to incoming water; the outflowing effluent can even have a darker color than the water entering the purification. The color of effluent is a clear visual disadvantage, but very little information is available on the chemical properties of the color of the effluent. Because the color can at some plants be for instance a key figure for emissions and on the other hand because only little studied information exists, the color is erroneously combined with lignin-content. In every case, when estimating the properties of effluent, the color has been regarded as such a significant disadvantage that color-containing effluent fails almost all evaluations concerning use as raw water in pulp processes. The basis of this invention is that the color of the effluent has no essential significance in view of bleaching, but color-containing water is under the conditions of ECF-bleaching and definitely also in TCF-bleaching a completely functioning raw water and produces similar bleaching results as bleachings performed with clean water.

Further, literature has repeatedly indicated that chlorides increase the development of brightness in the chlorine dioxide stage and that has been used as grounds for many filtrate solutions that have led to closing of bleaching. Our present invention removes detrimental lignin from the raw water of bleaching without any influence on the water color, but due to its chemical nature returns a remarkable amount of chloride back to the bleaching. Thus, a new raw water source for bleaching has been defined based on the previously lacking understanding of how the color of purified effluent especially in this case influences the bleaching result. Here, emphasize is made on a limitation that is essential for the invention, i.e. here it is referred to the color of such a biological purification plant only that has essentially originated in chemical pulping or other treatment of lignocellulosic fibers and the purification of effluent generated therein. Thus an invention is created that aims at treating, purification and recirculation back to the original process of a filtrate or filtrates from one bleaching line.

The present invention relates to method of treating and using liquid flows at a chemical pulp mill, said method comprising at least the following stages:

a) chemical pulp is produced in an alkaline cooking process, b) the brown stock generated in the cooking is treated, said treatment comprising washing of the pulp and preferably oxygen delignification and subsequent washing of the pulp, c) bleaching process for the treated brown stock, the bleaching sequence comprising at least one stage using chlorine dioxide and at least one oxidizing bleaching stage, and having at least two washing stages for treating the pulp with liquids and for producing filtrates, d) filtrates from stage c) are purified at an effluent plant of the chemical pulp mill, said plant comprising at least biological purification for obtaining purified effluent. The method is characterized in that it comprises a further stage: e) the purified effluent with a color of over 200 mg/l (Pt colour) and a COD value of over 150 mg/l is used as pulp treatment liquid in stage c).

According to an embodiment of the invention purified effluent is used after the first bleaching stage of the bleaching sequence and prior to the last oxidizing bleaching stage. Oxidizing bleaching chemical typically comprise oxygen, ozone and peroxide compounds, such as hydrogen peroxide and peracids, chlorine dioxide and hypochlorite. Typical oxidizing bleaching stages are thus EO-, EOP-, P- and Z-stages. In general, all bleaching stages are based on oxidation, excluding acid A-stage that is hydrolyze. Thus, purified effluent is not used for washing after the last oxidizing bleaching stage and not in pulp purification (screening) or pulp drying after the bleaching. When the liquid that is used for treating pulp after the last oxidizing bleaching stage is a liquid essentially cleaner than purified effluent, then the bleaching can be effected using "dirtier" liquid than recommended without compromising the brightness or the quality of the pulp. Here dirtiness refers to those parameters that are used for describing dirtiness, but does not essentially describe the harmfulness of the water in view of the bleaching stage.

In connection with the invention the biological effluent purification plant comprises at least aeration and final clarification, typically also preliminary clarification. The effluent is neutralized prior to aeration. The method according to the invention does not require tertiary treatment of the effluent.

Purified effluent is used in the pulp flow direction in the washing of the first bleaching stage or after that when a bleaching sequence requires dilution or washing water, but prior to the last oxidizing bleaching stage of the sequence. Purified effluent from stage d) is not used in the last washing apparatus prior to storing of the pulp, such as prior to a drying machine.

Pulp washing stages are typically between the bleaching stages. Purified effluent can be used in bleaching as dilution liquid or as washing liquid in a press, a washing press or a pressure drum washer, such as a Drum Displacer™ (DD)-washer of Andritz Oy, or another suitable pulp washing apparatus.

It has been noticed in connection with the present invention that although the color of the effluent after purification is over 200 mg/l (Pt colour), up to a level of 1000-2000 mg/l, typically 200-2000 mg/l (Pt colour), it has no significance for the bleaching result. The brightness or the quality of the pulp is not impaired when compared to a pulp that has been bleaching using a cleaner liquid. The COD-level of purified effluent is over 150 mg/l, even 200-400 mg/l, which also does not impair the bleaching result. Thus, the COD of purified effluent can be paralleled to e.g. condensates from an evaporation plant, wherein the chemical oxygen demand is generated from chemical compounds that do not essentially react with bleaching chemicals.

The most important component that causes brightness loss is lignin. However, in secondary treatment the color does not change in the same proportion as lignin is removed. The above mentioned WO patent applications 2008152185 and 2008152186 teach that when the lignin content of effluent is decreased in biological treatment, the effluent can be used e.g. in brown stock washing. The lignin content is to be decreased in the treatment by more than 50% in order to make the recirculation of purified effluent profitable. In biological treatment the color of effluent does not decrease by over 20%.

Biological treatment of effluent comprises preliminary clarification of the effluent, whereby a primary sludge is generated, and an activated sludge plant, in the aeration basin of which the effluent is treated with activated sludge that degrades impurities present in the effluent, such as lignin. The aeration basin is followed by final clarification, where activated sludge is separated from purified water; The present method utilizes just this kind of effluent purification, which has been recognized adequate for purifying effluent for reuse.

It is common knowledge that at bleaching plants with closed liquid cycles and a production rate of effluent under 20 $m^3$/adt, preferably under 15 $m^3$/adt the COD-content of the effluent increases in acid effluent to over 1300 mg/l and in alkaline to over 1800 mg/l. If the effluent amount decreases to remarkably below 15 $m^3$/adt, close to 10 $m^3$/adt, an increase in chemical consumption can be noticed. According to our understanding the use of purified effluent will be profitable especially when the COD-content of the bleach plant effluent increases to over 1500 mg/l, most preferably to over 1800 mg/l, whereby the decrease in the effluent amount obtained by means of internal closing of processes has reached a level where the accumulation of impurities in the effluent leads to excess consumption of chemicals. Then this COD-level has been formed from a bleaching process, washing losses of a washer after the oxygen stage and from condensates and chemicals that were used. In practice the COD of a bleaching plant's effluent is not over 5000 mg/l with a normal bleaching process.

Preferably the present method is used in a bleaching sequence having at least one stage using chlorine dioxide. Thereby chlorine compounds-containing filtrates are formed which are purified in biological effluent treatment, whereby the lignin-content is decreased by at least 50%, but the purification has no essential effect on the amount of chlorine compounds. According to the present method purified effluent is used inside the bleach plant only, whereby the chlocine compounds do not end up e.g. via brown stock washing into black liquor and further to chemical recovery. Thus, this method does not require a separate chlorine compound removal process or plant, when the effluent being purified is not used at the last washer of the oxygen stage. The recirculated chloride reacts in bleaching and thus even decreases the amount of required bleaching chemical to a slight extent.

Thus, the chloride in the purified effluent actually works in favor of a better bleaching result. In effluent treatment it is preferable to obtain as large a decrease in the lignin content as possible, while the chloride content can remain unchanged.

By means of effluent treatment the relation between lignin and chloride (total $Cl/Cl^-$) can be changed to an advantageous direction. In effluent circulation importance has been given to removal of color and metals, the relation between lignin and chloride has not been mentioned. Because chlorine/chloride is an inorganic substance that does not essentially evaporate, precipitate or form separable particles or compounds in purification plant conditions, in practice the whole amount of total chlorine that is fed in exits the plant entrained in liquid.

Metal control has also been regarded important when closing water circulation. However, it has been stated that the influence of metals is not of such importance and that during biological treatment the amount of removed metals is adequate at least in view of ECF-bleaching. This is because the pulp is neutralized in the purification and thereby the solubility of many metals is changed. If the solubility of a metal decreases, the delay of the purification process and the surroundings are adequate for precipitating a particle containing the metal so that it will not be passed back into the purified effluent.

In the present method, where biologically purified effluent is used inside a bleach plant, the consumption of bleaching chemicals remains essentially the same as when using clean water, when the aim is a certain brightness level of the pulp. The strength properties of the pulp do not change compared to the use of clean water.

The examples are based on a simplified model, where biological purification would treat the effluent coming from bleaching only and thus create the illustrated saving. Thereby a precondition is that other effluents of the mill are treated in another treatment line, where e.g. the amount of organic chlorine compounds is, however, very low. But if all effluents are treated in one and the same plant, the total decrease of bleaching-originated effluent is to be calculated as follows:

(amount of bleaching–originated effluent/total amount of effluent)*amount of effluent recirculated to the process=decrease in the amount of bleaching–originated effluent.

The less the amount of various leak waters or other waters led to the treatment plant, the greater the decrease in the amount of bleaching-originated effluent. Thus, when the aim is to close the bleaching plant, separate treatment of various effluent fractions becomes increasingly expedient.

The presented couplings illustrate a few various locations where purified effluent can be used. It is, however, obvious that purified effluent can be used in any washing apparatus, from where the pulp goes into a bleaching stage, thus excluding the last washing apparatus of bleaching upstream of drying or a paper machine, where the disadvantage caused by color is real. The last washing apparatus of bleaching can preferably use circulation water of a pulp dryer, hot water or condensate.

SUMMARY OF THE DRAWINGS

The present invention is described in more detail with reference to the appended figures, in which.

DETAILED DESCRIPTION

Figure 1:
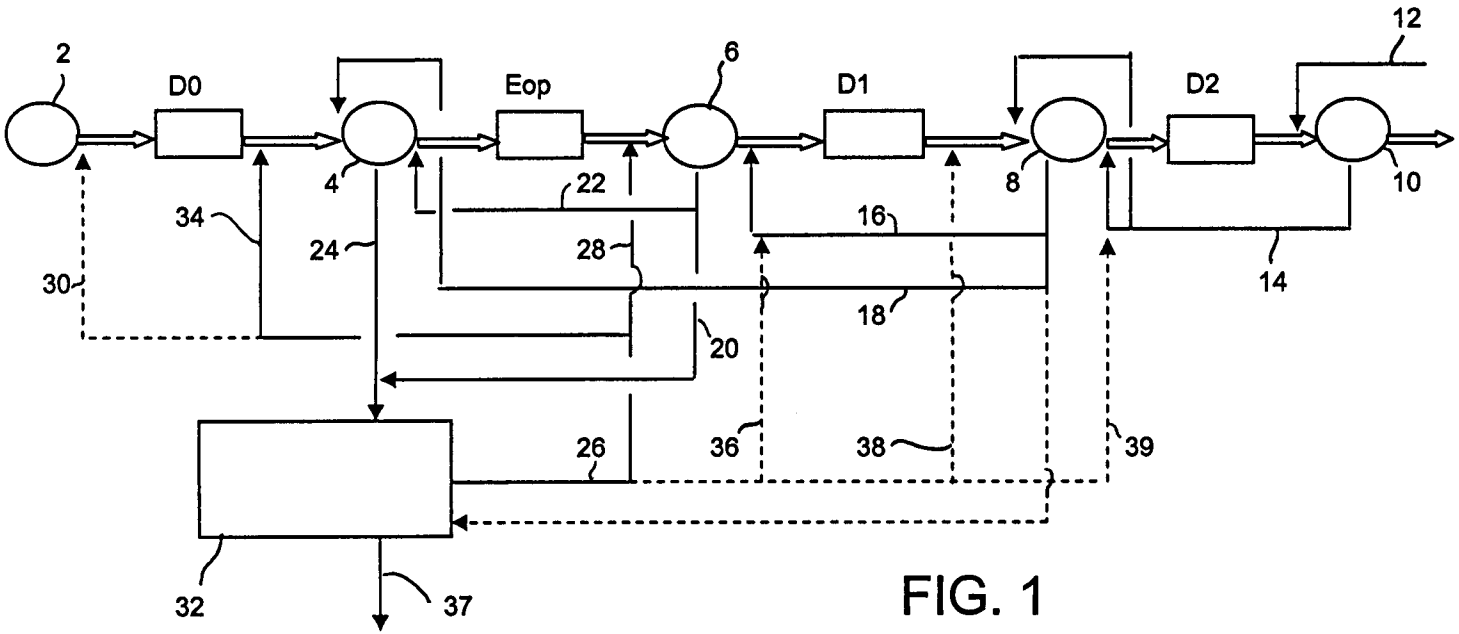
FIG. 1 illustrates a bleaching plant coupling.

FIG. 1 illustrates a bleaching plant using chlorine dioxide, said plant being preceded by a press 2. The bleaching sequence is D0-EOP-D1-D2.

The figure shows bleaching stages D0, EOP, D1 and D2 and the washing apparatus following each bleaching stage, which apparatuses in this example are washing presses. In the pulp flow direction the last D2-washer 10 receives washing water 12 that is circulation water from a drying machine or hot water or alternatively condensate (7-11 $m^3$/adt). The filtrate 14 from the D2-washer 10 is led to D1-washer 8 countercurrently with respect to the pulp and also to dilution downstream of the washer. Half of the D1-filtrate is led through line 16 after the EOP-washer 6 to dilute the pulp flow into the D1-stage. Half of the D1-filtrate is led via line 18 to dilute the pulp flow being fed to D0-washer 4. The filtrate 24 from the D0-washer 4 and a portion of filtrate from the EOP-washer 6 is led to the effluent treatment plant 32 of the mill to biological purification. A portion of the EOP-filtrate is taken via line 22 to the pulp flow downstream of the D0-washer 4.

Purified effluent can be introduced from line 26 for dilution of pulp coming from the press 2 before the D0-stage via line 30. Purified effluent is introduced via line 34 for dilution of pulp prior to the D0-washer 4 and for dilution of pulp flow prior to the EOP-washer 6 via line 28.

In the solution according to this embodiment the amount of the D0-washer filtrate that is typically taken into effluent purification is 10 $m^3$/adt and the amount of EOP-filtrate 20 is 5 $m^3$/adt. The amount of effluent being returned to the bleaching process is 10 $m^3$/adt. Then the amount of bleaching-originated effluent exiting the plant in line 37 is approximately 4-5 $m^3$/ADt.

FIG. 1 illustrates in broken lines 36, 38 and 39 alternative objects of application for purified effluent: Dilution after D0-stage prior to the D0-washer, dilution after the Eop-washer, dilution after the D1-stage prior to the D1-washer or dilution after the D1-washer. By using effluent also in these objects it is possible to reach even a zero-level of the bleaching-originated effluent amount exiting the mill. If needed, filtrate from the D1-washer can be led to effluent purification 32.

Figure 2:
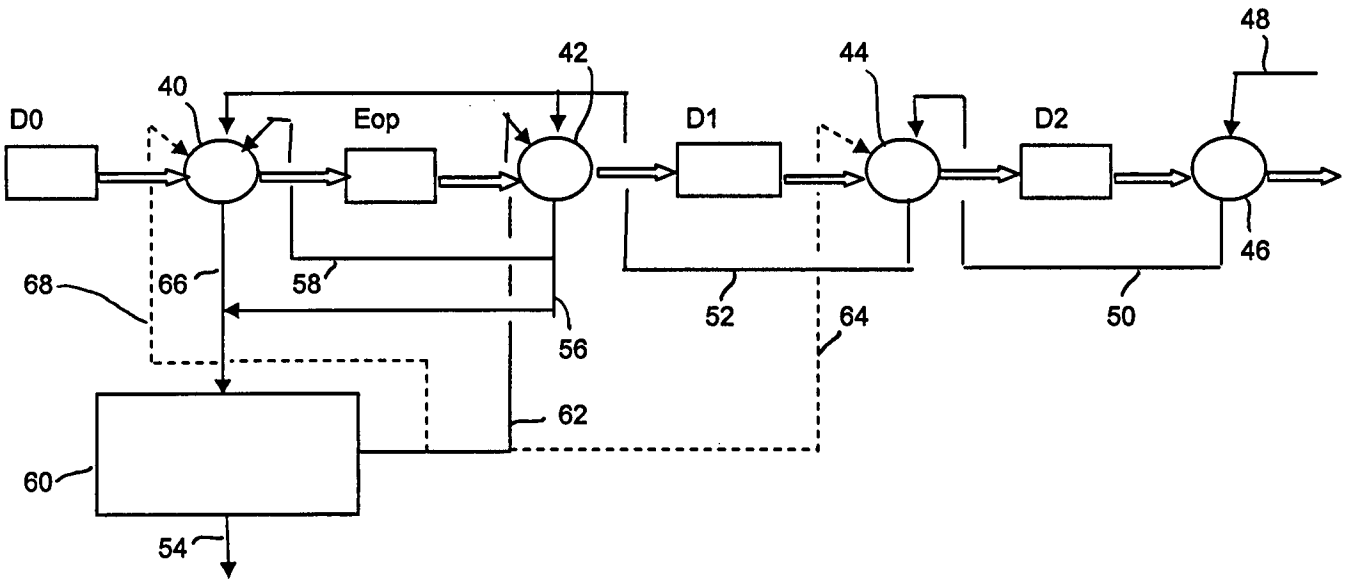
FIG. 2 illustrates another bleaching plant coupling.

FIG. 2 illustrates bleaching using chloride dioxide and having a sequence D0-EOP-D1-D2. The oxygen stage washing upstream thereof is effected with a Drum Displacer-type of washer.

FIG. 2 illustrates bleaching stages D0, EOP, D1 and D2 and the downstream washing devices for each bleaching stage, which in this example are drum washers of Drum Displacer type allowing multistage washing. The D2-washer 46 receives washing water 48 that is circulation water from a pulp dryer, hot water or condensate in the amount of 7-9 $m^3$/ADt. The D2-washer 46 filtrate 50 is led to the D1-washer 44 countercurrently with respect to the pulp. Half of the D1-filtrate 52 is led to EOP-washer 42. Half of the D1-filtrate 52 is led to the D0-washer 40. The filtrate 66 from the D0-washer 40 and a portion of filtrate 56 from the EOP-washer 42 is led to the effluent treatment plant 60 of the mill to biological treatment. A portion of the EOP-filtrate 58 is taken to the D0-washer 40.

Purified effluent is introduced as washing water to the EOP-washer 42 via line 62.

In the solution according to this embodiment the amount of the D0-washer filtrate that is typically taken into effluent purification is 10 $m^3$/adt and the amount of EOP-filtrate is 5 $m^3$/adt. The amount of effluent being returned to the bleaching process is 5 $m^3$/adt. The amount of effluent exiting the mill is approximately 11 $m^3$/ADt. This exiting purified effluent 54 can alternatively be taken to the D0-washer 40 and/or the D1-stage washer 44, as illustrated by lines 68 and 64.

EXAMPLES

The pulp was treated in bleaching sequences, whereby purified effluent was used as washing water and clean water was used as reference.

Example 1

| Sequence: A-EP-D-P | | | |
|---|---|---|---|
| Initial pulp | | | |
| Kappa | | 10.9 | |
| Brightness | | 63.3 | |
| | Clean A-stage | A-stage with effluent *) | A-stage and D1-stage with effluent **) |
| A-stage | 240 min, 90° C. | | |
| $H_2SO_4$, % | 0.52 | 0.55 | 0.55 |
| Final pH | 3.2 | 3.4 | 3.4 |
| EP-stage | 90 min, 85° C. | | |
| NaOH, % | 0.88 | 0.88 | 0.88 |
| $H_2O_2$, % | 0.55 | 0.55 | 0.55 |
| Brightness, % | 67 | 69 | 67 |
| D-stage | 120 min, 70° C. | | |
| $ClO_2$, % | 2 | 2 | 2 |
| Brightness, % | 83.8 | 83.8 | 84.5 |
| P-stage | 90 min, 85° C. | | |
| $H_2O_2$, % | 0.44 | 0.44 | 0.44 |
| $H_2O_2$, % consumed | 0.33 | 0.29 | 0.29 |
| NaOH, % | 0.72 | 0.72 | 0.72 |
| Brightness, % | 90.2 | 90.5 | 90.7 |
| Total | | | |
| $ClO_2$, kg/adt | 18 | 18 | 18 |
| $H_2O_2$, kg/adt | 9 | 9 | 9 |

*) Effluent trial: purified effluent 6.5 $m^3$/adt added to A-stage

**) Effluent trial: purified effluent 6.5 $m^3$/adt added to A-stage and 4 $m^3$/adt to D-stage Purified effluent. AOX 0.28 mg/l, COD 140 mg/l, color 400 mg/l Pt

Example 2

| Sequence: A/D-EP-D-P | | |
|---|---|---|
| Initial pulp | | |
| Kappa | 11.3 | |
| Brightness | 57.8 | |
| | Clean A-stage | A/D-stage with effluent |
| A/D-stage | 240 + 10 min, 90 + 85° C. | |
| $H_2SO_4$, % | 0.52 | 0.55 |
| Final pH | 3.2 | 3.4 |
| $ClO_2$, % | 0.45 | 0.45 |
| EP-stage | 90 min, 85° C. | |
| NaOH, % | 0.88 | 0.88 |
| $H_2O_2$, % | 0.56 | 0.56 |
| Brightness, % | 76.3 | 76 |

-continued

| Sequence: A/D-EP-D-P | | |
|---|---|---|
| D-stage | 90 min, 70° C. | |
| $ClO_2$, % | 1.33 | 1.33 |
| Brightness, % | 87. | 87.2 |
| P-stage | 90 min, 85° C. | |
| $H_2O_2$, % | 0.18 | 0.18 |
| $H_2O_2$, % consumed | 0.18 | 0.12 |
| NaOH, % | 0.7 | 0.7 |
| Brightness, % | 89.8 | 90.7 |
| Total | | |
| $ClO_2$, kg/adt | 17 | 17 |
| $H_2O_2$, kg/adt | 7 | 7 |

Effluent trial: 4.5 $m^3$/adt effluent added to A/D-stage

Purified effluent. AOX 1.6 mg/l, COD 180 mg/l. color 380 mg/l Pt

The examples show that the use of purified effluent in connection with bleaching does not deteriorate the qualities of the pulp. The brightness of the pulp is even better when using purified effluent compared to clean water.

The invention claimed is:

1. A method to process liquid flows at a chemical pulp mill comprising:

producing chemical pulp in an alkaline cooking process;

washing the chemical pulp generated in the cooking process;

bleaching the washed chemical pulp in a bleaching sequence comprising a chlorine dioxide stage, an oxidizing bleaching stage and at least two washing stages, wherein the bleaching sequence produces treated pulp and at least one separate stream of filtrates;

purifying the filtrates with a biological treatment to generate a purified effluent including a color of at least 200 mg/l (Pt) and a chemical oxygen demand (COD) level of at least 50 mg/l, and using the purified effluent as a pulp treatment liquid in the bleaching sequence upstream of the oxidizing bleaching stage.

2. The method of claim 1 wherein the oxidizing bleaching stage is the most downstream oxidizing bleaching stage in the bleaching sequence.

3. The method of claim 1 wherein the purified effluent is used in a first stage of the bleaching sequence stage or downstream thereof as dilution or washing water, and prior to the last oxidizing bleaching stage of the sequence.

4. The method according to claim 1 wherein the color of the purified effluent is in a range of 200 to 2000 mg/l (Pt).

5. The method according to claim 1 wherein the COD level of the filtrate flowing to the purification in stage is at least 1500 mg/l.

6. The method according to claim 1 wherein in a lignin content of the filtrate decreases by more than 50% in the purification stage.

7. The method according to claim 1 wherein the purified effluent is used as washing liquid at a pulp washer in the bleaching sequence.

8. The method according to claim 1 wherein the purified effluent is used as dilution liquid for a pulp washer in the bleaching sequence.

* * * * *